US006250107B1

(12) United States Patent
Visser

(10) Patent No.: US 6,250,107 B1
(45) Date of Patent: Jun. 26, 2001

(54) EXPANDABLE CHAIN CONSTRUCTION

(75) Inventor: Marianne Lorraine Visser, Amsterdam (NL)

(73) Assignee: Home & Nature Inc., Orlando, FL (US)

( * ) Notice: Subject to any disclaimer, the term of this patent is extended or adjusted under 35 U.S.C. 154(b) by 0 days.

(21) Appl. No.: 09/301,577

(22) Filed: Apr. 29, 1999

(51) Int. Cl.[7] ..... A44C 5/00

(52) U.S. Cl. ..... 63/3; 63/4; 63/5.1; 63/5.2; 63/11; 87/3; 87/4; 87/12; 87/13

(58) Field of Search ..... 63/3, 4, 5.1, 5.2, 63/11; 87/3, 4, 12, 13

(56) References Cited

U.S. PATENT DOCUMENTS

| | | | | |
|---|---|---|---|---|
| 41,175 | * | 1/1864 | Christl | 63/4 |
| 149,823 | | 4/1874 | Baker et al. . | |
| 149,824 | | 4/1874 | Baker et al. . | |
| 149,826 | | 4/1874 | Baker et al. . | |
| D. 203,859 | | 2/1966 | Anderson . | |
| 239,361 | | 3/1881 | Bissinger . | |
| 240,206 | | 4/1881 | Vester et al. . | |
| D. 301,699 | | 6/1989 | Markovits . | |
| D. 333,107 | * | 2/1993 | Nakagawa | D11/13 |
| D. 335,470 | | 5/1993 | Gradi . | |
| D. 394,020 | | 5/1998 | Cerato . | |
| D. 411,812 | * | 7/1999 | Visser | D11/13 |
| D. 411,813 | * | 7/1999 | Visser | D11/13 |
| D. 411,964 | * | 7/1999 | Visser | D11/13 |
| D. 412,134 | * | 7/1999 | Visser | D11/13 |
| D. 413,829 | * | 9/1999 | Visser | D11/13 |
| D. 414,715 | * | 10/1999 | Visser | D11/13 |
| D. 414,716 | * | 10/1999 | Visser | D11/13 |
| D. 415,059 | * | 10/1999 | Visser | D11/13 |
| 482,229 | | 9/1892 | Cremonesi . | |
| 788,221 | | 4/1905 | Richardson . | |
| 973,601 | | 10/1910 | Widenmeyer . | |
| 1,440,647 | * | 1/1923 | Terry | 2/339 |
| 1,607,808 | | 11/1926 | Anthony . | |
| 1,807,440 | | 5/1931 | Schraysshuen et al. . | |
| 2,218,559 | | 10/1940 | Stephens . | |
| 2,231,485 | | 2/1941 | Straight et al. . | |
| 2,425,465 | | 8/1947 | Goldblatt . | |
| 3,066,897 | | 12/1962 | Richardson . | |
| 3,540,109 | | 11/1970 | Marthaler . | |
| 3,614,876 | | 10/1971 | Lenfant . | |
| 3,798,729 | | 3/1974 | Tanaka . | |
| 4,733,544 | | 3/1988 | Londaro . | |
| 5,285,658 | | 2/1994 | Altman et al. . | |
| 5,444,903 | | 8/1995 | Wachler . | |

OTHER PUBLICATIONS

A photograph of a necklace/bracelet dating from 1996, source unknown.

Brading & Knotting/Techniques & Projects, Constantine A. Belash—cover pg and pp. 102–103. Undated.

Step–By–Step Series, cover pg and pg entitled Half Hitch and Alternative Half Hitch. Undated.

Cover pg reading "This edition first published in 1975 in Great Britain . . . ", cover pg, p. 74 and pg entitled Half Hitch.

* cited by examiner

*Primary Examiner*—Anthony Knight
*Assistant Examiner*—Andrea Chop
(74) *Attorney, Agent, or Firm*—Schweitzer Corman Gross & Bondell LLP

(57) ABSTRACT

An expandable chain construction comprises first and second chain lengths of a monofilament such as nylon fishing line. Each chain length is formed into a series of spaced loops, the loops of the two lengths being of opposite senses. Each loop of each length encircles a portion of the other length lying between a pair of loops. Chain constructions may be interconnected along their lengths to form chains of increased width. The chain constructions are expandable to fit closely but gently about a wearers limb. The construction can simulate the appearance of tatoo designs.

9 Claims, 4 Drawing Sheets

EXPANDABLE CHAIN CONSTRUCTION

The present invention relates to a new and improved construction for an expandable chain of particular use for costume jewelry.

BACKGROUND OF THE INVENTION

Chain constructions are utilized in the jewelry arts, both to support other jewelry objects, such as pendants, and as objects of body adornment themselves when formed into bracelets, rings and the like. Typically, the chains are non-extensible, and therefore must be carefully sized to meet the requirements of the wearer.

Tatoos, decorative ornamentation applied directly to the skin, often through a non-reversible process, represent a different methodology of body adornment. Because of the non-reversible nature of the tatoo application process, coupled with the time, cost and sometimes pain which is associated with the process, tatoos are often not considered by those who would otherwise be favorably disposed towards a product yielding such an appearance of adornment for themselves.

It is accordingly a purpose of the present invention to provide a jewelry chain construction which is of an extensible nature allowing jewelry items formed of the chain to conform to differently-sized portions of the body upon which the resulting jewelry item is applied.

It is a further purpose of the present invention to provide a jewelry chain construction which can be found in a variety of adornment objects, such as rings, bracelets and necklaces.

Another purpose of the present invention is to provide a jewelry chain construction which can simulate a tatoo-like design without in any way defacing the skin and which allows the design to be removed or relocated by the wearer as desired.

BRIEF DESCRIPTION OF THE INVENTION

In accordance with the foregoing and other objects and purposes, the jewelry chain construction of the present invention comprises interconnected lengths of a flexible chain-forming, generally inextensible monofilament material. Each length of the monofilament material may comprise one or more generally parallel individual monofilament elements formed into a series of loops, which may either be overlapping or spaced along the length of monofilament material. The loops of a first monofilament length encircle a second monofilament length at spaced locations, while the loops of the second monofilament length encircle the first monofilament length at spaced locations, yielding an extensible open multiple loop chain construction. The adjacent ends of the interconnected monofilament lengths may be joined together to prevent the chain construction from unraveling. The combination of the series of loose interconnected loops and the monofilament line material provides a chain construction which has resiliency which allows the construction to stretch along its longitudinal axis thus that, when the chain is formed into a closed construction, such as a bracelet, and placed on a limb, such as a wrist, a properly-sized looped chain construction fit firmly, but gently upon the wrist while displaying the loop structure. So displayed, the appearance of the construction can simulate a tatoo-like design, without any of the disadvantages associated with tatoos.

A plurality of chain constructions formed of first and second monofilament elements may be further interconnected along their respective lengths to create chain designs of differing widths. In addition, the formed loops may be of differing sizes along the monofilament lengths.

A fuller understanding of the present invention will be attained upon consideration of the following detailed description of illustrative embodiments thereof, when viewed in connection with the annexed figures, wherein.

DETAILED DESCRIPTION OF THE INVENTION

Figure 1:
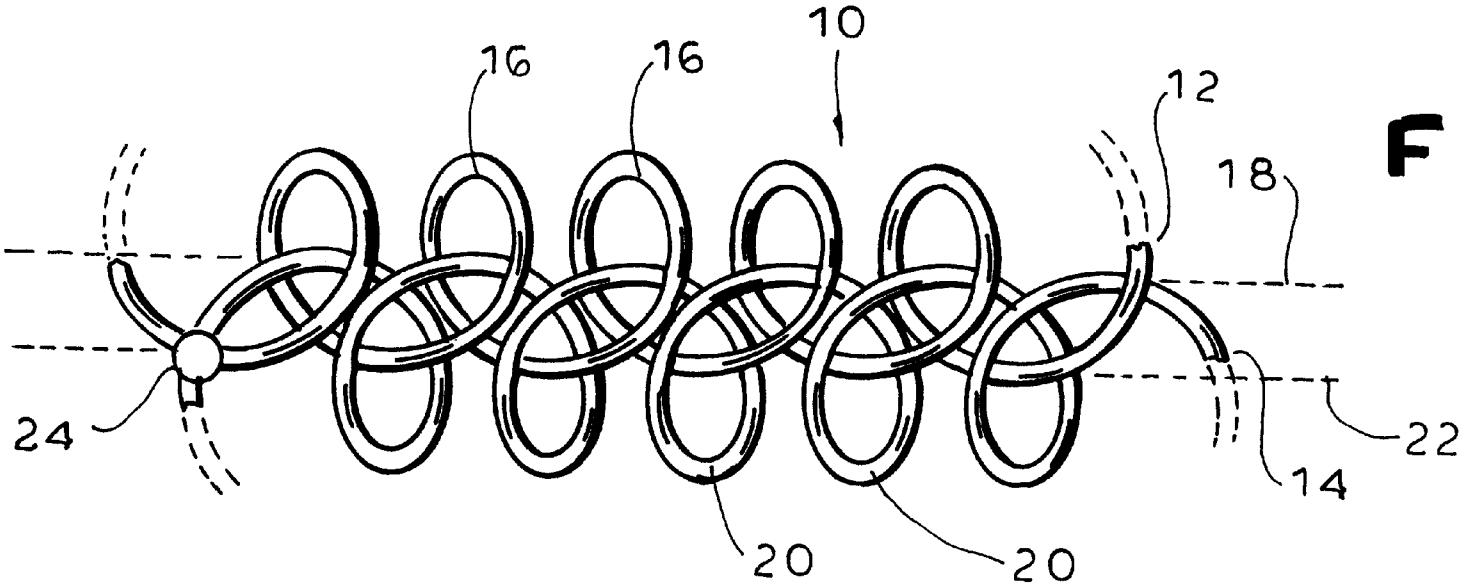
FIG. 1 is a plan view of a first embodiment of a chain construction of the present invention.

With initial reference to FIG. 1, there is shown a first chain construction 10 formed in accordance with the present invention. As shown therein, the chain construction is formed from first and second lengths 12, 14 of a generally non-extensible monofilament material, such as nylon fishing line. Each length of monofilament material comprises a single monofilament element which, while non-extensible, is flexible and has a degree of inherent resiliency. First length 12 is formed into a continuing series of first (right)-handed loops 16 as seen along the length from right to left in the Figure. As can be further seen in FIG. 1, the loops can be described as extending upwardly from a lower axis or reference line 18 extending along the length of the chain construction. In a similar manner, second length 14 consists of a continuing series of second (left-handed) loops 20 extending downwardly from second longitudinal axis or reference line 22. Each of the loops 16 of the first length 12 encircles an intermediate portion of the second length 14 lying between a pair of adjacent loops 20, while each of the loops 20 in second length 14 similarly encircles an intermediate portion of first filament 12 between a pair of adjacent loops 16. A chain construction of any desired length may be created by the continuous forming and interconnecting of the loop structures of the first and second lengths.

The interconnected loop construction may be formed by hand, with first ends of each of the lengths 12, 14, affixed to an appropriate mounting block or fixture as known in the art. Alternatively, the lengths may comprise separate portions of a single monofilament element folded back upon itself about the starting block or fixture. Automated equipment may also be utilized to make continuous lengths of chain. A given length of the chain construction 10 may have the ends of the lengths 12 and 14 fastened together as depicted at 24 to terminate the chain and prevent the lengths from unraveling. The lengths may be joined together by mechanical means, such as knotting, or may be bound together by a heat welding process, use of a mechanical fastener, or combinations of the foregoing. The opposed ends of the chain may be joined or interconnected together to form a closed loop bracelet, ring, necklace or the like, as desired.

Figure 2:
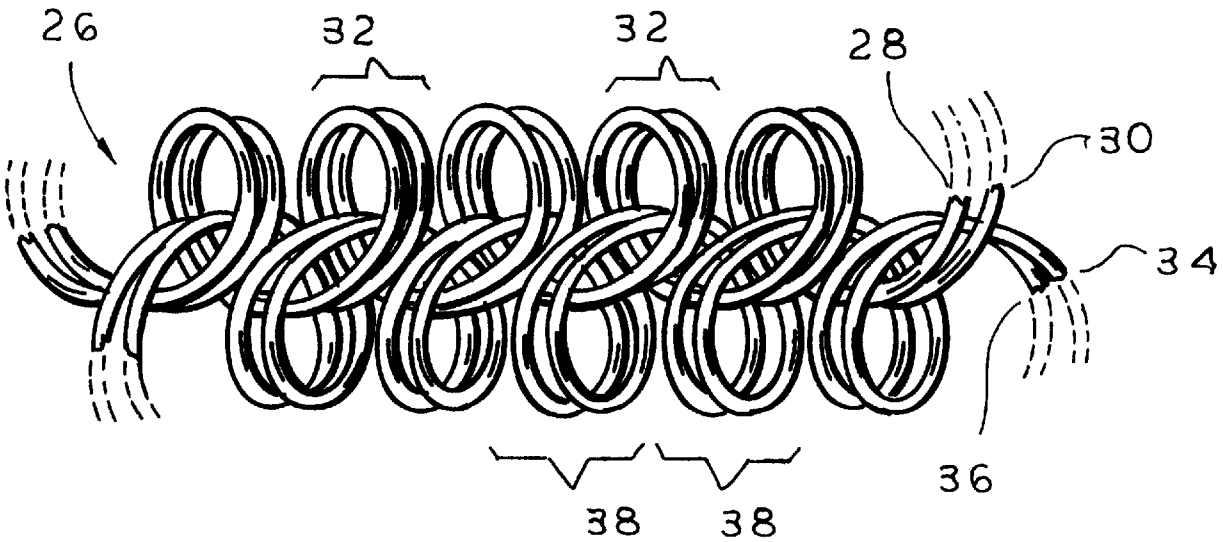
FIG. 2 is a plan view of a second embodiment of a chain construction of the present invention.

Each of the loops of a length encircle intermediate portions of both of the monofilament elements of the other length. As depicted in FIG. 2, chain construction 26 utilizes a pair of generally parallel monofilament elements 28, 30 in length 12 to form a continuing series of loops 32, while parallel monofilament elements 34, 36 in length 14 form the loops 38.

Figure 3:
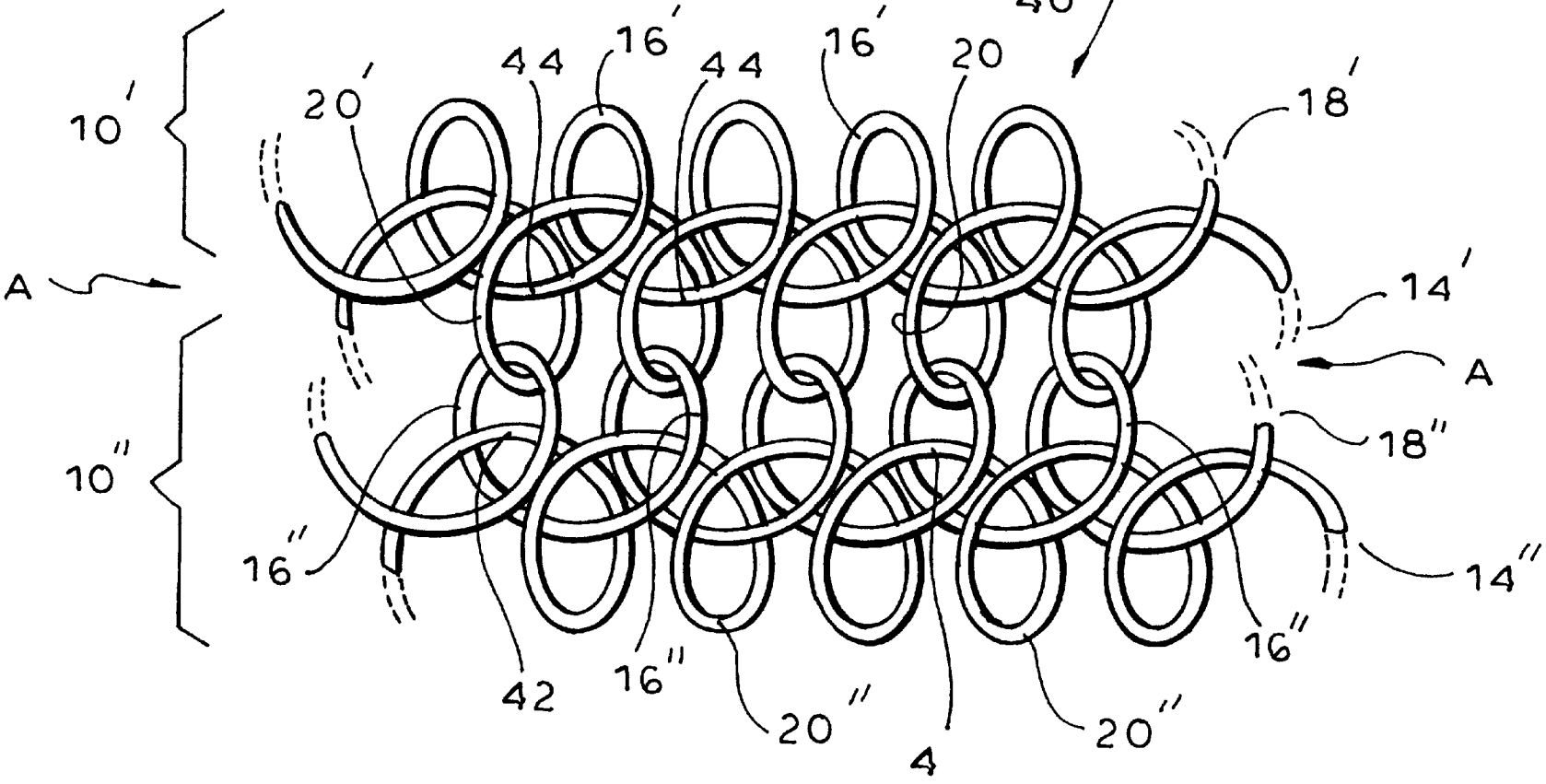
FIG. 3 is a plan view of a third embodiment of a chain construction of the present invention comprising a pair of chain constructions depicted in FIG. 1 joined along their lengths.

The lengths 12 and 14 may be formed of multiple monofilament elements in an analogous manner. As illustrated in FIG. 3, chains as depicted in FIGS. 1 or 2 may be interconnected to form wider chain constructions. As shown therein, first and second chain constructions 10' 10", as depicted in FIG. 1, are joined together along their respective lengths to form a wider chain construction 40 by interconnecting loops 20' of the first construction 10' with corresponding loops 16" of the second construction 10". In a similar manner, a third chain construction 10'" (not shown) may be joined to chain 10' or 10" to form a yet wider chain construction. By interconnecting adjacent loops of parallel chains, chains of any desired width can be formed.

Once again, the loops of each length of each of the constructions may be formed from single or multiple monofilament elements. Consecutive and adjacent loops may be interconnected, as shown in FIG. 3, or the loops of a chain element can encircle consecutive intermediate portions of another chain element. Such a construction is represented in FIG. 3 by the loops 20' encircling the intermediate locations 42 on element 14 while the loops 16" encircle the intermediate location 44 on element 18'.

Figure 4:
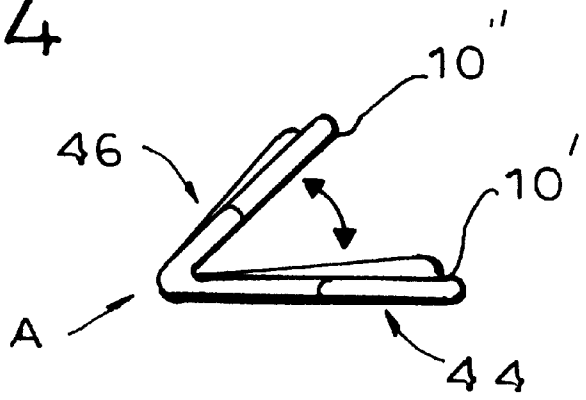
FIG. 4 is a diagrammatic end view of the embodiment of FIG. 3 in a folded configuration.

When wider chain elements, such as illustrated in FIG. 3, are formed, the line of connection between adjacent chain constructions 10', 10" . . . , provides a longitudinal fold axis, depicted by the arrows A—A in FIG. 3, which allows the resulting structure to take a more three-dimensional appearance. As depicted in FIG. 4, two "arms" may thus be formed at an angle to each other. The first arm 44 comprises the chain 10' while the second arm 46 comprises the chain 10". This angle may be typically on the order of from 15 to 90 degrees and may be further maintained when the chain is formed into a closed loop for purposes of use as a headband, bracelet or the like. With chain construction of greater width additional fold axis between adjacent chain constructions 10', 10". . . can be formed and utilized to provide further three-dimensional effects.

Figure 5:
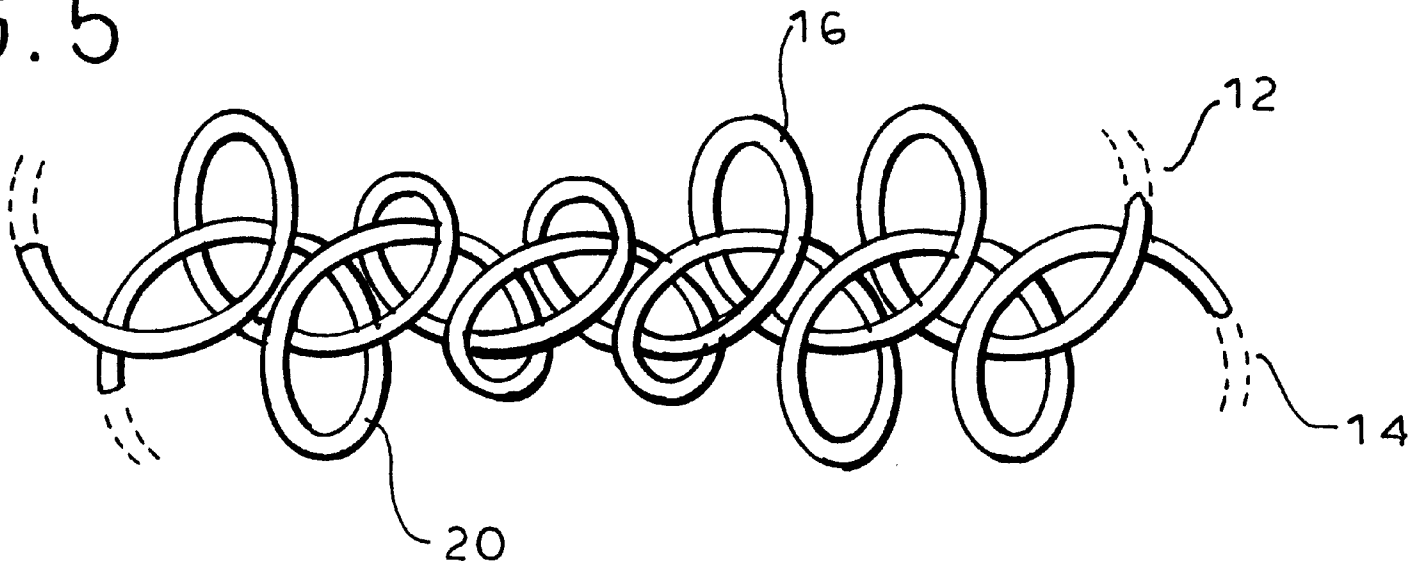
FIG. 5 is a plan view of a fourth embodiment of a chain construction of the present invention.

Monofilament elements of various sizes and colors may be utilized in constructions of the present invention. Monofilaments in the range of 2 to 6 mm may be successfully used. The loops formed in a given length may be of similar size, as depicted in FIGS. 1 or 2, or may be of differing sizes, as shown in FIG. 5. The open nature of the loops, in conjunction with the flexible and non-extensible lengths of the monofilament elements from which the lengths are formed, allow the resulting construction to expand to encircle and gently embrace a limb, as may be desired.

I claim:

1. An expandable jewelry chain construction, comprising:

a first chain length comprising at least one non-extensible monofilament element formed into a series of first-handed open loops joined by intermediate line portions; and a second chain length comprising at least one non-extensible monofilament element formed into a series of second, opposite-handed open loops joined by intermediate line portions;

the loops of said first chain length encircling consecutive intermediate line portions of said second chain length and the loops of said second chain length encircling consecutive intermediate line portions of said first chain length.

2. The expandable jewelry chain construction of claim 1 further comprising a third and a fourth chain length each comprising at least one non-extensible monofilament element formed into a series of open loops joined by intermediate line portions, the loops of said third chain length encircling consecutive intermediate line portions of said fourth chain length and the loops of said fourth chain length encircling consecutive intermediate line portions of said third chain length, the loops of said third chain length further encircling consecutive portions of one of said first or second chain lengths.

3. The expandable jewelry chain construction of claim 2, wherein said loops of said third chain length encircle consecutive loops of the one of said first or second chain lengths.

4. The expandable jewelry chain construction of claim 2 wherein said loops of said third chain length encircle intermediate line portions of the one of said first or second chain lengths.

5. The expandable jewelry chain construction of claim 4, wherein loops of the said one of said first or second chain lengths encircle intermediate line portions of said third chain length.

6. The expandable jewelry chain construction of claim 2, wherein said first and second chain lengths lie generally in a first plane and said third and fourth chain lengths lie in a second plane.

7. The expandable jewelry chain construction of claim 1, wherein each of said loops of said first and second chain lengths are of generally equal dimensions.

8. The expandable jewelry chain construction of claim 1, wherein the loops of at least one of said first and second chain lengths are of differing dimensions.

9. The expandable jewelry chain construction of any of claims 1 to 8 wherein the monofilament elements are nylon line.

* * * * *